US006945670B2

(12) United States Patent
Sejkora et al.

(10) Patent No.: US 6,945,670 B2
(45) Date of Patent: Sep. 20, 2005

(54) LUMINAIRE

(75) Inventors: Günther Sejkora, Schwarzenberg (AT); Jürg Zumtobel, Dornbirn (AT)

(73) Assignee: Zumtobel Staff GmbH, Dornbirn (AT)

( * ) Notice: Subject to any disclaimer, the term of this patent is extended or adjusted under 35 U.S.C. 154(b) by 17 days.

(21) Appl. No.: 09/988,464

(22) Filed: Nov. 20, 2001

(65) Prior Publication Data

US 2002/0048168 A1 Apr. 25, 2002

Related U.S. Application Data

(63) Continuation of application No. PCT/EP00/03571, filed on Apr. 19, 2000.

(30) Foreign Application Priority Data

May 20, 1999 (DE) ..... 199 23 225
May 27, 1999 (DE) ..... 299 09 282 U

(51) Int. Cl.[7] ..... F21V 5/00

(52) U.S. Cl. ..... 362/233; 362/327; 362/330; 362/290; 362/354; 362/345

(58) Field of Search ..... 362/327, 330, 362/290, 354, 342, 320, 345, 244, 245, 247, 329, 31, 328

(56) References Cited

U.S. PATENT DOCUMENTS 5,396,350 A * 3/1995 Beeson et al. ..... 359/40
5,550,657 A * 8/1996 Tanaka et al. ..... 359/49
5,667,289 A * 9/1997 Akanane et al. ..... 362/31
5,839,823 A * 11/1998 Hou et al. ..... 362/327
5,914,760 A * 6/1999 Daiku ..... 349/65
6,185,357 B1 * 2/2001 Zou et al. ..... 385/133
6,238,065 B1 * 5/2001 Jones ..... 362/339
6,299,328 B1 * 10/2001 Wilson ..... 362/223
6,305,811 B1 * 10/2001 Beeson et al. ..... 362/31
6,334,690 B1 * 1/2002 Ohkawa ..... 362/31
6,523,980 B2 * 2/2003 Sejkora et al. ..... 362/339

FOREIGN PATENT DOCUMENTS

| | | |
|---|---|---|
| AT | 403403 | 2/1998 |
| EP | 0860655 A2 | 8/1998 |
| EP | 0911577 A2 | 4/1999 |
| EP | 1139013 A2 | 10/2001 |
| JP | 10106319 | 4/1998 |
| WO | WO 95/12782 | 5/1995 |
| WO | WO 97/36131 | 10/1997 |

* cited by examiner

*Primary Examiner*—Thomas M. Sember
(74) *Attorney, Agent, or Firm*—Fitzpatrick, Cella, Harper & Scinto

(57) ABSTRACT

There is proposed a luminaire (10) with which the exit angle of the light beams is restricted for the purpose of anti-dazzling. Further, in accordance with the invention there is attained in a simple manner and in particular without the employment of a light guide element a uniform emission of light over the entire surface of an optical element (14; 14-1, 14-2) arranged before or in the emission opening (13) of the luminaire (10). The optical element (14; 14-1, 14-2) has a plate-like core (16) of transparent material, which is occupied on one side with microprisms (17) which, with the formation of furrows (18)—starting from their roots—taper.

15 Claims, 3 Drawing Sheets

State of the Art

State of the Art

LUMINAIRE

This is a Continuation of copending International Application PCT/EP00/03571 filed Apr. 19, 2000, and published on Nov. 30, 2000 in German but not in English, the priority of which is hereby claimed,

BACKGROUND OF THE INVENTION

1. Field of the Invention

The present invention relates to a luminaire having an optical element with a microprism structure for restricting the exit angle of light beams out of the luminaire.

2. Description of the Related Art

By means of optical elements of the kind mentioned above it is intended to be attained that the exit angle of light beams out of the luminaire is restricted, i.e. is smaller than a predetermined limit exit angle, in order to reduce dazzling for the observer. Further, such an optical element effects also a mechanical protection of the luminaire and in particular of the lamp in the interior of the luminaire.

Such an optical element is known for example from Austrian Patent AT-B403, 403. As is shown in FIG. 1, the known optical element has on its side towards the lamp of the luminaire pyramid-like profilings 2, so-called microprisms, arranged in rows and columns, which are formed as truncated pyramids starting from a plate-like core 3 and having an upper boundary surface (light entry surface) parallel to the base surface (light exit surface) of the core 3. The entire optical element 1 is completely of a glass clear or transparent material.

A further optical element of the kind mentioned in the introduction is disclosed for example in WO 97/36131. As shown in FIG. 2, the known luminaire 4 has a lamp 5, such as for example a fluorescent tube or the like, a reflector housing 6 surrounding the lamp 5, and an optical element 1. The optical element 1 is likewise of a plate-like core 3 of transparent material which on one side is occupied by microprisms 2 which with the formation of furrows 7—starting from their roots—taper, whereby the entirety of the microprism outer surfaces form the light entry surface 8. In order to ensure limiting of the exit angle of the light beams out of the optical element 1, lenses 9 are provided on the other side of the core 3 which forms the light exit surface.

With the known luminaire systems, although through the employment of the appropriately configured optical element an anti-dazzling effect is ensured for the observer, the brightness distribution of the light over the optical element is however not uniform, since in the vicinity of the lamp more light beams enter into the optical element than for example in the edge regions of the optical element. Although the lamp cannot be directly recognized through the optical element, due to the greater brightness its position can at least be sensed by the observer.

In order to attain a uniform emission of light of the illumination arrangement it is known, for example from WO 95/12782, to couple light from a lamp from the side into a light conductor element, which transports the light primarily parallel to its light exit surface. On the light exit surface of the light conductor element there is applied a microprism structure which on the one hand makes possible a coupling out of the light out of the light conductor and on the other hand restricts the exit angle of the illumination arrangement. Attention is, however, drawn to the fact that the illumination arrangement described in WO 95/12782 is a background illumination for displays or other screens and is not entirely suitable for room illumination.

SUMMARY OF THE INVENTION

Starting from the above-mentioned state of the art, it is the object of the present invention to make available a luminaire with which the exit angle of the light beams is restricted for the purpose of anti-dazzling and at the same time in a simple manner and in particular without the employment of a light conductor element there is attained an emission of the light over the entire surface of the optical clement which is as uniform as possible.

In accordance with a first aspect of the invention this object is achieved by means of a luminaire having a reflector which is so arranged and shaped with reference to the lamp that in substance only light that is reflected at the reflector can leave the emission opening through the optical element. Thereby it is achieved that the light beams coming out of the lamp couple into the optical element, uniformly distributed thereon, and then exit out of this optical element with an exit angle which is smaller than a predetermined limit exit angle.

Preferably the inner side of the reflector is formed to be diffusely reflecting, in order to further increase the effect of uniform distribution of the light beams.

In accordance with a preferred exemplary embodiment of the invention, the microprisms of the optical element are arranged of the manner of a matrix (crossing structure). In aceordance with a furter preferred exemplary embodiment of the invention, the microprisms of the optical element have an elongate structure, i.e. they extend in one direction of extension of the optical element in substance over the entire length of the optical element (longitudinal structure).

In accordance with a second aspect of the invention, the above object is achieved by means of a luminaire wherein the inner side of the reflector surrounding the elongate lamp is formed to be reflecting in a mirror-like manner, and the microprisms of the optical element have an elongate structure (longitudinal structure) and they extend transversely to the lamp or to the longitudinal axis of the lamp. With a luminaire arrangement constructed in such a manner the reflector deflects the light transversely to the lamp longitudinal axis and provides in this direction for a uniform brightness distribution and anti-dazzling effect, and the microprism structure of the optical element provides for an anti-dazzling effect parallel to the longitudinal axis of the lamp.

In accordance with a third aspect of the present invention, the above object is achieved by means of a luminaire having in total two optical elements which are similarly constructed and the microprisms of which have in each case an elongate structure. The second optical element is arranged parallel to the first optical element, the microprisms of the second optical element running transversely to the microprisms of the first optical clement, i.e. the two optical elements are with reference to the direction of extension of their microprisms, rotated by 90° one to the other. By means of this construction the same anti-dazzling effect is attained as with a single optical element the microprisms of which are arranged in a raster or matrix manner, but the manufacture of optical elements having a longitudinal structure is simpler and therefore also more economical than the manufacture of optical elements having a crossing structure.

Further advantageous configurations and developments of the present invention are described and claimed hereinafter.

BRIEF DESCRIPTION OF THE DRAWINGS

The invention will be described below in more detail with reference to various preferred exemplary embodiments and with reference to the accompanying drawings, wherein.

DETAILED DESCRIPTION OF THE PREFERRED EMBODIMENT

Figure 1:
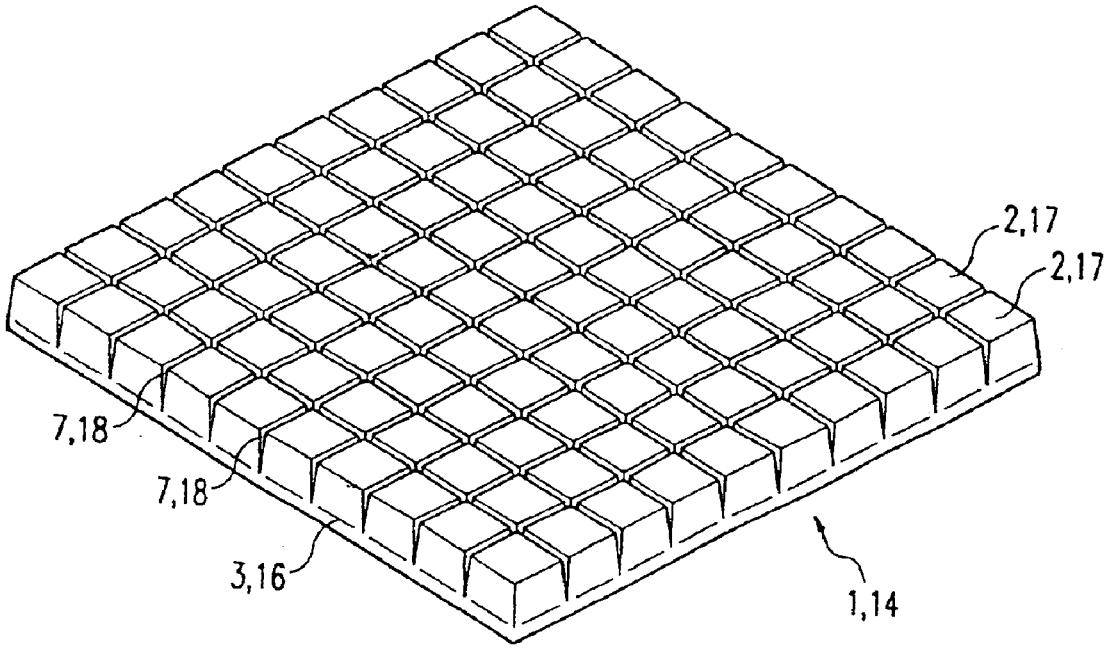
FIG. 1 shows a known optical element in a perspective representation, seen from a lamp of a luminaire.
Figure 2:
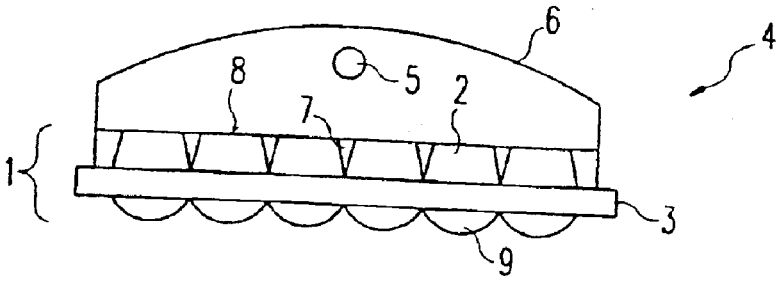
FIG. 2 shows a known luminaire arrangement in section.
Figure 3:
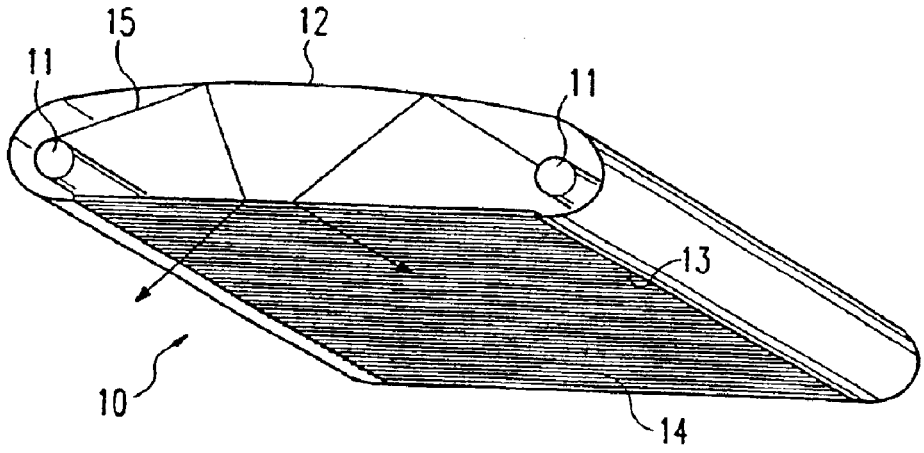
FIG. 3 shows a first exemplary embodiment of a luminaire according to the present invention, in a schematic perspective illustration from the viewpoint of an observer.
Figure 4:
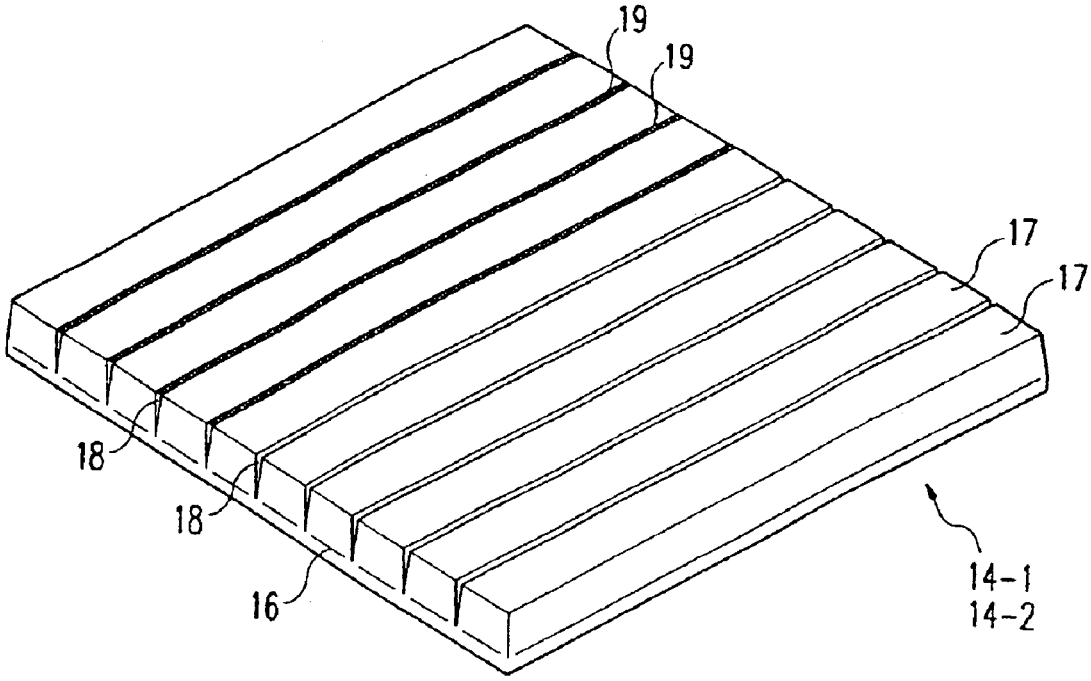
FIG. 4 shows an optical element, in a perspective representation from the viewpoint of the lamp of the luminaire of FIG. 3, which can be put to use in a luminaire in accordance with the invention.
Figure 5:
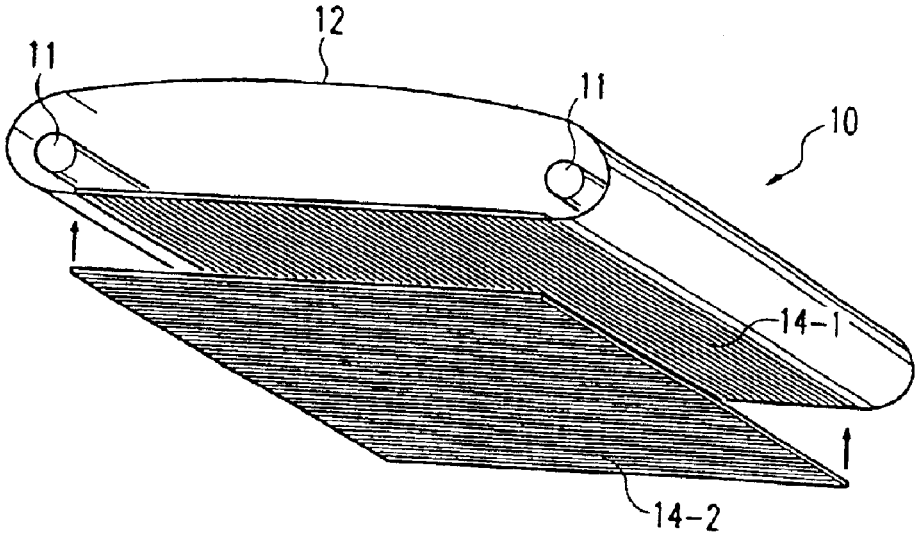
FIG. 5 shows a second exemplary embodiment of a luminaire in accordance with the present invention, in a schematic perspective illustration from the viewpoint of an observer.
Figure 6:
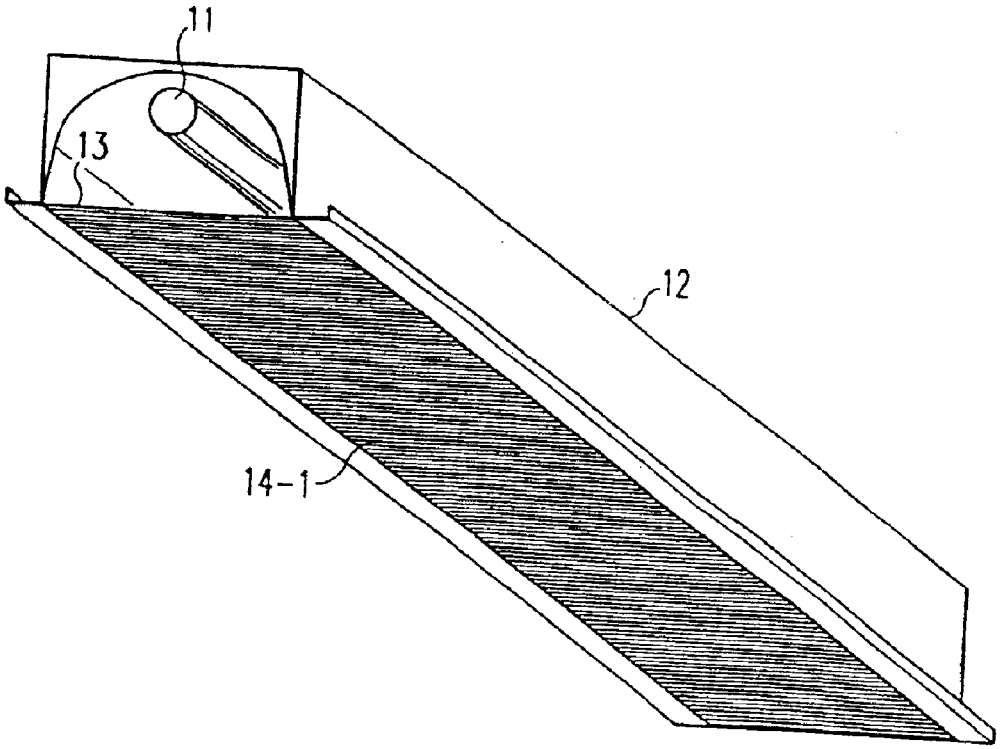
FIG. 6 shows a third exemplary embodiment of a luminaire in accordance with the present invention, in a schematic perspective illustration from the viewpoint of an observer.

In FIGS. 3, 5 and 6 there are schematically illustrated three preferred exemplary embodiments of luminaires in accordance with the invention. Optical elements which are put to use in these luminaires are shown in FIGS. 1 and 4.

The first exemplary embodiment in accordance with FIG. 3 comprises a luminaire 10 having two elongate lamps 11, such as for example fluorescent tubes. The lamps 11 are surrounded by a corresponding reflector 12, which has at its lower side an emission opening 13. The reflector 12 may either itself serve as a housing of the luminaire or be arranged and mounted in a corresponding (not shown) luminaire housing. In or before the emission opening 13 of the reflector 12 an optical element 14 is emplaced, which in substance corresponds to the known element illustrated in FIG. 1.

The optical element 14 arranged in or before the emission opening 13 serves for the deflection of light beams 15 entering thereinto and again emerging therefrom, such that their exit angle is restricted, i.e. is smaller than a predetermined limit exit angle of about 60–70°. For this purpose the optical element 14 has a plate-like core 16 of transparent material, such as for example acrylic glass, which is occupied on one side with microprisms 17 which, with the formation of furrows 18—starting from their roots—taper, whereby the entirety of the microprism outer surfaces form the light entry surface and the other side of the core 16 forms the light exit surface. In the first exemplary embodiment of FIG. 3, the microprisms 17 are arranged matrix-like in rows and columns (crossing structure).

Alternatively, it is also conceivable to install the optical element 12 in the luminaire 10 the other way round. In this case, the entirety of the microprism outer surfaces forms the light exit surface and the other side of the core 16 forms the light entry surface.

The lamps 11 are arranged laterally offset with reference to the emission opening 13 or the optical element 14. Further, the reflector 12 is so arranged and shaped with the regard to the lamps 11 that the light beams 15 emitted from the lamps 11 cannot be directly emitted through the emission opening 13, i.e. in substance only light beams 15 reflected at the reflector 12 can leave the emission opening 13 through the optical element 14. Preferably the inner side of the reflector 12 is formed to be diffusely reflecting, such as for example being painted white or coated with highly reflective Teflon.

The construction of optical element 14 with the microprism structure 17 brings about, in known manner, an anti-dazzling effect of the light beams for the observer, i.e. a restriction of the exit angle of the light beams 15 out of the lurninaire 10. In that no or virtually no light beams are emitted directly from the lamps 11 through the optical element 14, but in substance only light beams 15 reflected at the inner side of the reflector 12 couple into the optical element 14 and then leave this element downwardly, there is achieved a uniform or at least virtually uniform illumination of the entire surface of the optical element 14. This effect is further promoted by means of a diffusely reflecting inner side of the reflector.

Instead of the employment of two elongate fluorescent tubes 11, as shown in FIG. 3, it is just as possible to provide an annular fluorescent tube 11 outside of a corresponding emission opening 13 of the reflector 12. Further, other arbitrary lamp shapes and kinds are naturally conceivable for employment in the luminaire 10 in accordance to the present invention. The same applies also for the exemplary embodiments described below.

A second exemplary embodiment of a luminaire 10 will now be described with reference to FIGS. 4 and 5. The second exemplary embodiment differs from the first exemplary embodiment in that in total two optical elements 14-1 and 14-2 are arranged in or before the emission opening 13 of the reflector 12. Otherwise, the construction of the luminaire 10, i.e. in particular the arrangement of the lamps 11 and of the reflector 12, corresponds to that of the first exemplary embodiment.

Both optical elements 14-1, 14-2 of the luminaire 10 are constructed in accordance with FIG. 4. In contrast to the optical element in accordance with FIG. 1 having a microprism structure 17 arranged in a matrix-like manner, the microprisms 17 of this exemplary embodiment have an elongate structure. In other words, the microprisms extend, in one direction of extension of the optical element, over in substance the entire length of the optical element 10 (longitudinal structure), whilst in the other direction they are arranged one after another. By means of the elongate microprisms 17 there is attained a transverse anti-dazzling effect, perpendicular to the direction of extension of the microprisms 17. Thus, if one arranges two such optical elements 14-1, 14-2 having longitudinal structures in parallel one above another, the direction of extension of the microprisms 17 of one optical element 14-1 being rotated by 90° with respect to the direction of extension of the microprisms 17 of the other optical element 14-2, i.e. the microprisms of the first optical element 14-1 run transversely to the microprisms of the second optical element 14-2, one achieves the same effect as with a single optical element 14 having crossing structure. However, the manufacture of the optical elements 14-1, 14-2 having longitudinal structure is simpler and therefore more economical than the manufacture of the optical elements 14 having crossing structure.

In the exemplary embodiment of FIG. 5, the first optical element 14-1 is so arranged that the elongate microprisms 17 are directed parallel to the longitudinal axis of the lamps 11, while the direction of extension of the microprisms 17 of the second optical element 14-2 runs transversely to the longitudinal axis of the lamps 11. The optical elements 14-2 and 14-1 may, just as well, be mounted in the reverse sequence in or before the emission opening 13 of the reflector 12, without this having an effect on the optical characteristics of the overall arrangement.

As is further partially indicated in FIG. 4, the intermediate spaces or ftirrows 18 between the neighboring microprisms 17 are preferably covered over with a reflecting material 19, for example a metal foil having high reflectivity. By these means it is achieved that only light passing from the lamps 11 via the reflector 12 is incident upon the outer surface of the microprisms 17 forming the light entry surface, and is emitted through the optical element 14-1, 14-2. The light beams incident upon the cover 19 are reflected back into the interior of the luminaire 10 and then reflected back from the inner side of the reflector 12 again in the direction towards the optical element 14-1, 14-2.

By means of such a reflecting cover 19, the efficiency of the optical element 14-1, 14-2 can be further increased. Instead of the cover 19 shown in FIG. 4 it is also possible to completely fill the furrows 18 between the microprisms 17 with a reflecting material. In this way the side walls of the microprisms 17 are also formed to be totally reflecting, so that light beams which are incident upon these side walls from the interior cannot leave the microprisms 17.

The measures mentioned here in relation to the exemplary of the optical elements 14-1, 14-2 of FIG. 4 can naturally also be applied in all other embodiments of the present invention, in particular in the exemplary embodiments of FIGS. 3 and 6, in analogous manner.

With reference to FIG. 6 there will now be described a third exemplary embodiment of a lurninaire 10 in accordance with the present invention.

An elongate lamp 11, for example a fluorescent tube, is surrounded by a corresponding, likewise elongate reflector 12 or reflector housing. The reflector 12 has at his lower side an emission opening 13, which is closed with an optical element 14-1. The optical element 14-1 corresponds to the configuration shown in FIG. 4; that is, it has in particular a longitudinal structure of the microprisms 17. The optical element 14-1 is, as shown in FIG. 6, so directed that the microprisms 17 run transversely to the longitudinal axis of the lamp 11.

In contrast to the two exemplary embodiments above, here the inner side of the reflector 12 is formed to be mirror-reflecting, and the lamp 11 is not laterally offset but arranged in the middle over the optical element 14-1. Despite this, also in this case there can he achieved a uniform illumination of the optical element 14-1 and an anti-dazzling effect of the light beams, i.e. a restriction of the exit angle of the light beams out of the luminaire 10, since the mirror-reflecting inner surface of the reflector 12 deflects the light transversely to the longitudinal axis of the lamp 11 and therefore provides in this direction both for an anti-dazzling effect and also for a uniform illumination, the optical element 14-1 provides, due to the longitudinal structure of the microprisms 17 transversely to the longitudinal axis of the lamp, for an anti-dazzling effect parallel to the longitudinal axis of the lamp, and a uniform illumination parallel to the longitudinal of the lamp is automatically provided due to the elongate form of the lamp.

As in the case of the first exemplary embodiment, also with the luminaires 10 in accordance with the second and third embodiments, the optical elements 14-1, 14-2 may be so arranged before or in the emission opening 13 of the luminaire 10 that either the entirety of the microprism outer surfaces forms the light entry surface and the other side of the core forms the light exit surface, or vice versa.

What is claimed is:

1. A luminaire comprising:

at least one lamp;

a reflector surrounding the lamp, a side of said reflector facing towards said lamp being reflecting, said reflector being formed with an emission opening for emission of light; and an optical element arranged in or before the emission opening for deflecting light beams which enter into a light entry surface and exit from a light exit surface opposite to said light entry surface of the optical element such that light beams exit from said optical element at an exit angle which is smaller than a predetermined limit exit angle of about 70°, said optical element having a plate-like core of transparent material which is occupied on said light entry surface with tapered microprisms formed by furrows, each of said microprisms having on at least two sides roots from which said microprism tapers, said reflector being shaped and arranged with reference to said lamp such that only light beams reflected at said reflector and impinging on said light entry surface can exit said light exit surface.

2. A luminaire according to claim 1, wherein said reflector has an inner side towards said lamp which inner side is formed to be diffusely reflecting.

3. A luminaire according to claim 2, wherein said inner side of the reflector is painted white or is coated with highly reflecting Teflon.

4. A luminaire according to any of claims 1 to 3, wherein said luminaire includes two elongated lamps arranged parallel to one another and laterally offset with respect to said emission opening.

5. A luminaire according to any of claims 1 to 3, further including an annular lamp which is arranged laterally outwardly offset with respect to said emission opening.

6. A luminaire according to any of claims 1 to 3, wherein said microprisms of said optical element are arranged in a matrix-like manner.

7. A luminaire according to any of claims 1 to 3, wherein said microprisms have an elongate structure.

8. A luminaire comprising:

at least one lamp;

a reflector surrounding the lamp, a side of said reflector facing towards said lamp being reflecting, said reflector being formed with an emission opening for emission of light;

an optical element arranged in or before the emission opening for deflecting light beams which enter into and exit from the optical element such that light beams exit from said optical element at an exit angle which is smaller than a predetermined limit exit angle of about 70°, said optical element having a plate-like core of transparent material which is occupied on one side with microprisms formed by furrows, said microprisms having roots from which said microprisms taper, said reflector being shaped and arranged with reference to said lamp that only light beams reflected at said reflector can exit said emission opening through said optical element, and a second optical element arranged to deflect light beams which enter into and exit from said second optical element, such that said light beams exit from said second optical element at an exit angle which is less than a predetermined limit exit angle, said second optical element being constructed in the same manner as the optical element, wherein said second optical element is formed with further microprisms which have an elongate structure, and said second optical element is arranged parallel to said optical element and the microprisms of said second optical element are directed transversely to the microprisms of said optical element.

9. A luminaire according to any of claims 1 to 3, wherein the furrows between the microprisms are covered over by a reflecting material or are filled with a reflecting material, in order to prevent an entry of the light beams through the furrows into the microprisms.

10. A luminaire comprising:

an elongated lamp;

an elongate reflector configured to surround said lamp, said reflector having an inner side the inner side facing towards the lamp and being formed to be reflecting, said reflector being formed with an emission opening for emission of light; and an optical element arranged in or before said emission opening, for deflecting light beams which enter into a light entry surface and exit from a light exit surface opposite to said light entry surface of said optical element at an exit angle which is smaller than a predetermined exit angle of about 70°, said optical element having, on a light entry side thereof, a plate-like core of transparent material, and having a light exit side which is occupied on said light entry surface with microprisms which are formed by furrows each of said microprisms having on at least two sides roots from which said microprism tapers, said inner side of said reflector being formed to be mirror-reflecting, and being arranged with reference to said lamp such that only light beams reflected at said reflector and impinging on said light entry surface can exit said light exit surface, and said microprisms having an elongate structure and extending transversely of said lamp.

11. A luminaire according to claim 10, wherein said furrows between said microprisms are covered by a reflecting material or are filled with a reflecting material, in order to prevent an entry of light beams through the furrows into the microprisms.

12. A luminaire comprising:

an elongated lamp;

an elongate reflector configured to surround said lamp, said reflector having an inner side the inner side facing towards the lamp and being formed to be reflecting, said reflector being formed with an emission opening for emission of light;

a first optical element arranged to deflect light beams which enter into and exit from said first optical element to exit from said first optical element at an exit angle which is smaller than a predetermined exit angle of about 70°, said first optical element having a plate-like core of transparent material which is occupied on a light exit side thereof with microprisms and furrows, said microprisms having roots from which said microprisms taper, and said microprisms of said first optical element having an elongate structure; and a second optical element arranged to deflect light beams which enter and exit from said second optical element to exit from said second optical element at an exit angle which is smaller than a predetermined limit exit angle, said second optical element being of the same construction as said first optical element and being formed with microprisms, the microprisms of said second optical element likewise having an elongate structure, said second optical element being arranged parallel to said first optical elements, said microprisms of said second optical element extending transversely to said microprisms of said first optical element, and said inner side of said reflector being formed to be mirror-reflecting, and being arranged with reference to said lamp that only light beams reflected at said reflector can exit said emission opening through said first optical element.

13. A luminaire according to claim 12, wherein the furrows between the microprisms of at least one of said first and second optical elements being covered over by means of a reflecting material or being filled with a reflecting material, in order to prevent an entry of the light beams through said furrows into said microprisms.

14. A luminaire according to claim 8, wherein said reflector has an inner side towards said lamp which inner side is formed to be diffusely reflecting.

15. A luminaire according to claim 14, wherein said inner side of the reflector is painted white or is coated with highly reflecting Teflon.

* * * * *